US006285131B1

(12) United States Patent
Kiss et al.

(10) Patent No.: US 6,285,131 B1
(45) Date of Patent: Sep. 4, 2001

(54) MANUFACTURING IMPROVEMENT FOR XENON ARC LAMP

(75) Inventors: John Kiss, San Jose; Daniel Joseph O'Hare, Livermore; Roy D. Roberts, Hayward, all of CA (US)

(73) Assignee: EG&G ILC Technology, Inc., Sunnyvale, CA (US)

( * ) Notice: Subject to any disclaimer, the term of this patent is extended or adjusted under 35 U.S.C. 154(b) by 0 days.

(21) Appl. No.: 09/305,145

(22) Filed: May 4, 1999

(51) Int. Cl.[7] ..... H01J 17/16

(52) U.S. Cl. ..... 313/634; 313/576; 313/570; 313/110; 445/26; 445/29

(58) Field of Search ..... 313/113, 110, 313/634, 284, 285, 570, 576, 573, 567, 643; 445/26, 29

(56) References Cited

U.S. PATENT DOCUMENTS 3,495,118 * 2/1970 Richter ..... 313/112
3,715,615 * 2/1973 Lavering ..... 313/204
3,725,714 * 4/1973 Anderson ..... 313/110
4,940,922 * 7/1990 Schuda et al. ..... 315/246
5,721,465 2/1998 Roberts ..... 313/46

* cited by examiner

*Primary Examiner*—Nimeshkumar D. Patel
*Assistant Examiner*—Karabi Guharay
(74) *Attorney, Agent, or Firm*—Thomas E. Schatzel; Law Offices of Thomas E. Schatzel

(57) ABSTRACT

A xenon arc lamp is provided with an improved cathode support. The improvements reduce the number of assembly procedures and parts needed to produce an arc lamp. Such reduces the overall cost of manufacturing. The cathode suspension system is made by starting with a single piece of sheet Kovar material that is formed into a cup. Pieces are cut from the bottom of the cup such that three webs connect the outside ring to the center. The three webs each have a flap that is then folded back 90° to form a rigid strut arm. A tungsten cathode electrode is brazed at the center and apex of the three struts with a sleeve that helps bridge the fillet area.

9 Claims, 2 Drawing Sheets

MANUFACTURING IMPROVEMENT FOR XENON ARC LAMP

BACKGROUND OF THE INVENTION

1. Field of the Invention

Figure 1:
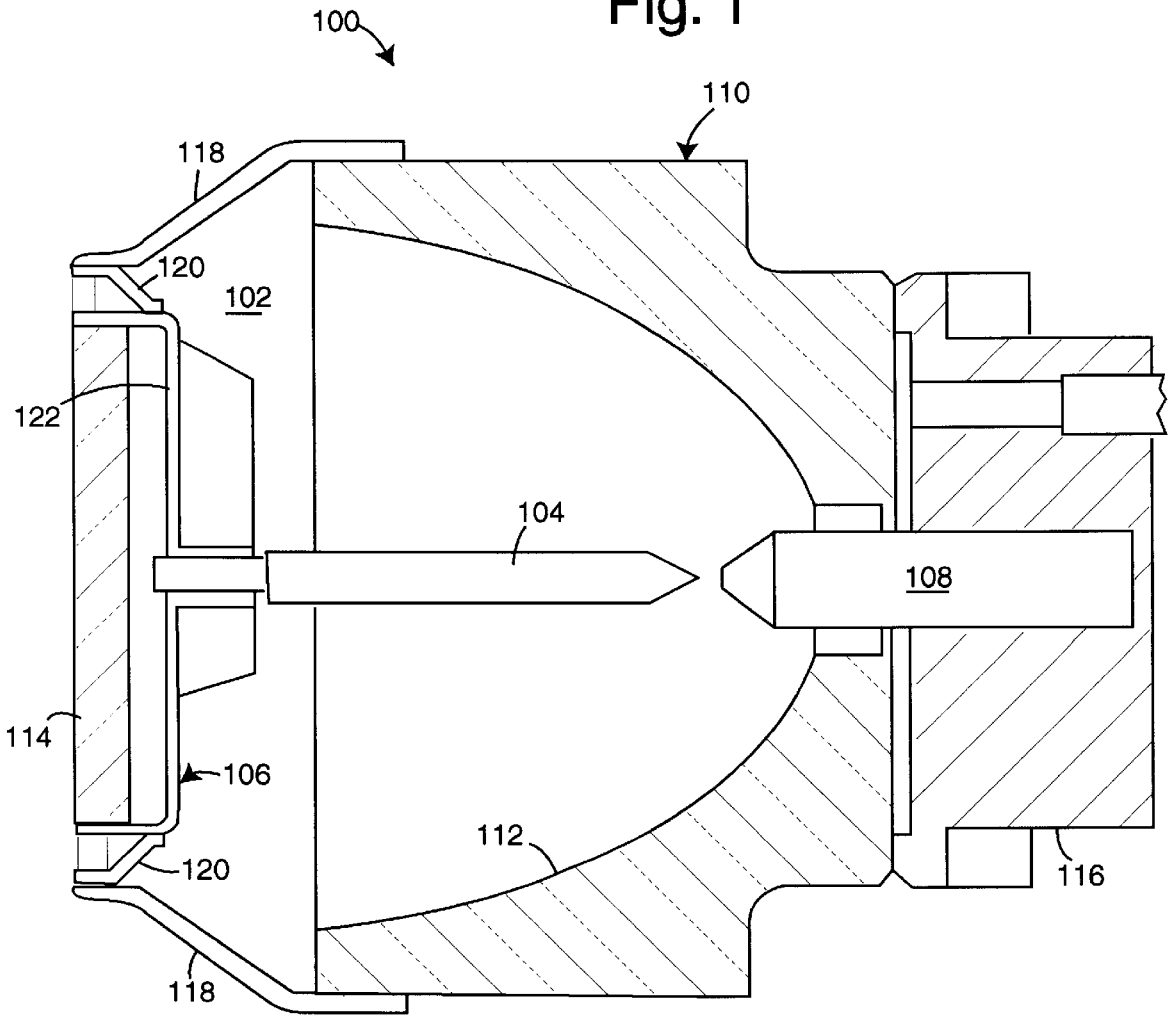

The invention relates generally to arc lamps, and specifically to components and methods used to reduce the cost of manufacturing xenon arc lamps.

2. Description of the Prior Art

Short arc lamps provide intense point sources of light that allow light collection in reflectors for applications in medical endoscopes, instrumentation and video projection. Also, short arc lamps are used in industrial endoscopes, for example in the inspection of jet engine interiors. More recent applications have been in color television receiver projection systems.

A typical short arc lamp comprises an anode and a sharp-tipped cathode positioned along the longitudinal axis of a cylindrical, sealed concave chamber that contains xenon gas pressurized to several atmospheres. U.S. Pat. No. 5,721,465, issued Feb. 24, 1998, to Roy D. Roberts, describes such a typical short-arc lamp. A typical xenon arc lamp, such as the CERMAX marketed by ILC Technology (Sunnyvale, Calif.) has a three-legged strut system that holds the cathode electrode concentric to the lamp's axis and in opposition to the anode.

The manufacture of high power xenon arc lamps involves the use of expensive and exotic materials and sophisticated fabrication, welding, and brazing procedures. Because of the large numbers of xenon arc lamps being produced and marketed, every opportunity to save money on the materials and/or assembly procedures is constantly being sought. Being the low-cost producer in a market always translates into a strategic competitive advantage.

The three-legged strut system used in the CERMAX-type arc lamp requires two more brazes and three more parts than that for embodiments of the present invention. It is estimated that just the strut assembly alone in the CERMAX-type arc lamp costs \$15–\$20. The strut system of the present invention that could replace it is estimated to cost only \$3.00–\$3.50.

SUMMARY OF THE PRESENT INVENTION

It is therefore an object of the present invention to provide a xenon arc lamp with reduced manufacturing costs.

Briefly, an embodiment of the present invention is a xenon arc lamp with an improved cathode support. The improvements reduce the number of assembly procedures and parts to produce an arc lamp. A single piece of sheet Kovar material is formed into a cup. Pieces are cut from the bottom of the cup so that three webs connect the outside ring to the center. The three webs each have a flap that is folded back 90° to form a rigid strut arm. A tungsten cathode electrode is brazed at the center and apex of the three struts with a sleeve that helps bridge the fillet area.

An advantage of the present invention is that a xenon arc lamp is provided that is less costly to produce compared to conventional designs.

These and other objects and advantages of the present invention will no doubt become obvious to those of ordinary skill in the art after having read the following detailed description of the preferred embodiment which is illustrated in the drawing figures.

IN THE DRAWINGS

Figure 2A:
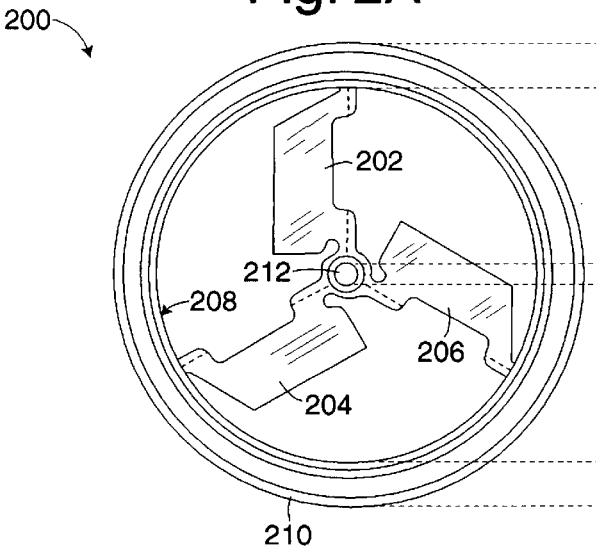
Figure 2B:
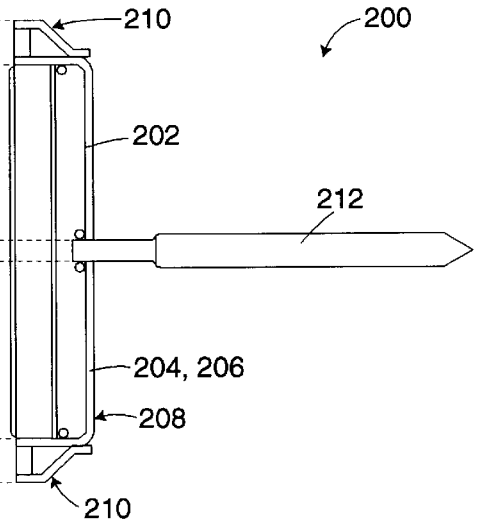
Figure 3A:
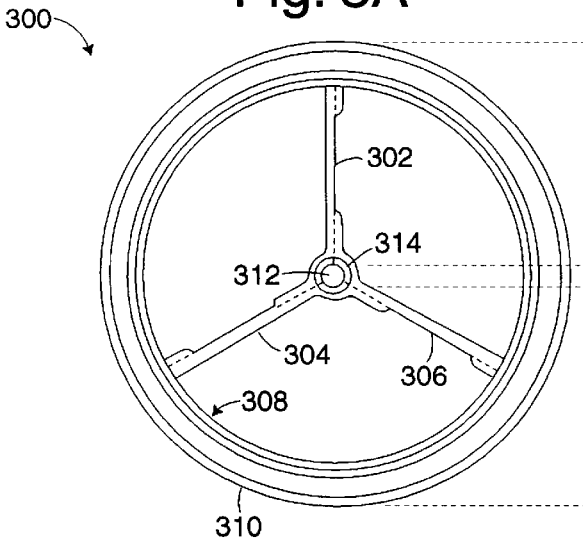
Figure 3B:
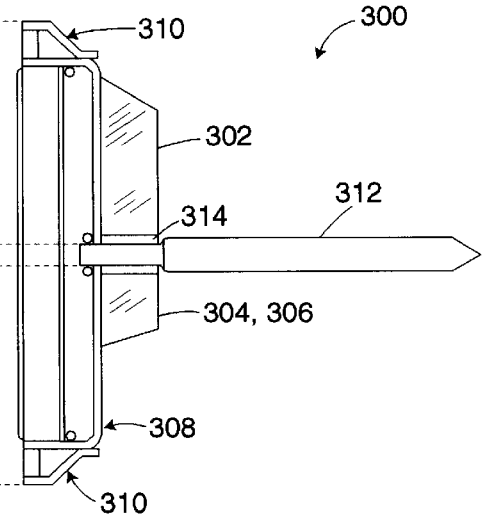

FIG. 1 is a cross-sectional diagram of a high-intensity short arc lamp embodiment of the present invention;

FIGS. 2A and 2B are end-view and side-view diagrams of a cathode support strut system embodiment of the present invention before the flaps on three webs are folded over, and is useful in the manufacture of the arc lamp of FIG. 1; and FIGS. 3A and 3B are end-view and side-view diagrams of the same cathode support strut system of FIGS. 2A and 2B, but after the flaps on three webs have been folded over.

DETAILED DESCRIPTION OF THE PREFERRED EMBODIMENT

FIG. 1 illustrates a high-power xenon short-arc lamp, referred to herein by the general reference numeral 100. The lamp 100 comprises a xenon atmosphere 102 within which is disposed a cathode 104 supported by three-legged cathode-suspension strut system 106, and an anode 108. The xenon atmosphere 102 is enveloped by a ceramic body 110, an elliptical reflective surface mirror 112, a sapphire lens 114, and a copper base 116. It is important that the cathode 104 be suspended and held firmly in its proper place. The three-legged suspension strut system 106 resists three-dimensional flexing and inter-electrode gap variations between the cathode and anode. An outer lamp-front-end ring 118 necks down to a smaller diameter into-which is brazed a suspension ring 120. A lens cup 122 has its inside forward surface sealed to the sapphire lens 114. The combination of the outer lamp-front-end ring 118, the suspension ring 120, the lens cup 122, and the sapphire lens 114, provide a complete seal of the forward end of the ceramic body 110 to contain the xenon atmosphere 102.

The lens cup 122 has special cutouts in its rear flat panel that allow three struts to be formed by bending out a portion of each of three webbings. After bending, each strut has an L-shaped cross-section and is structurally quite rigid. Kovar sheet about 0.020 inches thick is generally preferred for the outer lamp-front-end ring 118, the suspension ring 120, and the lens cup 122. The cathode 104 and anode 108 are generally preferred to be made from tungsten. The outer lamp-front-end ring 118 provides an electrical contact for the cathode to an igniter. The base 116 provides an electrical contact between the anode 108 and the igniter.

FIGS. 2A, 2B, 3A, and 3C represent a three-legged suspension strut system embodiment of the present invention, and is referred to by the general reference numerals 200 and 300. The strut system 200 is shown before each of three flaps 202, 204, and 206 are folded over 90°. Such folds are made along the dashed lines on the webbing in the drawing. The flaps are fabricated as cutouts in a cup 208. A ring 210 is brazed to the outer edge of the cup 208 and allows for some expansion and contraction to occur without stressing the ceramic body of an arc lamp that the combination attaches to. A cathode electrode 212 is brazed to the center, and is typically 1.016 inches long. The cup 208 is made of 0.020 inch Kovar sheet material, has a typical outer diameter of 1.048 inches, and a depth of 0.245 inches.

The strut system 300 is shown after each of the three flaps are folded over to complete each of three struts 302, 304, and 306, respectively. A cup 308 is shown after bending the struts. A ring 310 and a cathode 312 are equivalent to the ring 210 and cathode 212 of FIGS. 2A and 2B. A sleeve 314 is slipped over the cathode 312 before brazing and helps bridge a braze-fillet area between each strut and the cathode. The sleeve 314 is typically made of 0.125 inch diameter Kovar rod 0.145 inches long and drilled with a 0.066 inch central bore. Three longitudinal slots, 0.022 inches wide and 0.010 inches deep, can be provided to receive the inside edges of each strut.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An improved xenon arc lamp, the improvements comprising:

a cup formed from a single sheet of Kovar material;

a series of three cutouts in a bottom floor of the cup such that a set of three webs remain that connect an outer ring of the cup to a center hub;

a flap in each of said three webs that provides for a portion to be folded over such that a rigid strut system is created;

a tungsten cathode electrode attached to said center hub; and a sleeve that bridges a fillet area between the tungsten cathode electrode and each corresponding inside edge of said flaps;

wherein said rigid strut system suspends the tungsten cathode electrode in opposition to an anode electrode in a xenon gas atmosphere and maintains a correct arc gap.

2. The improved xenon arc lamp of claim 1, the improvements further comprising:

a sapphire lens attached all along its circumference inside said cup and providing for a containment seal of said xenon gas atmosphere.

3. The improved xenon arc lamp of claim 1, the improvements further comprising:

a suspension ring with a larger diameter end and a smaller diameter end and attached all along its inner circumference of its smaller diameter end to an outer circumference of the cup, and providing for expansion and contraction during lamp operation.

4. The improved xenon arc lamp of claim 3, the improvements further comprising:

an outer lamp-front-end ring with a larger diameter end for attachment to a ceramic body of said arc lamp, and a smaller diameter end attached all along its inner circumference to an outer circumference of said larger diameter end of the suspension ring.

5. An improved xenon arc lamp, the improvements comprising:

a cup formed from a single sheet of Kovar material;

a series of three cutouts in a bottom floor of the cup such that a set of three webs remain that connect an outer ring of the cup to a center hub;

a flap in each of said three webs that provides for a portion to be folded over such that a rigid strut system is created;

a tungsten cathode electrode attached to said center hub;

a sleeve that bridges a fillet area between the tungsten cathode electrode and each corresponding inside edge of said flaps;

a sapphire lens attached all along its circumference inside said cup and providing for a containment seal of said xenon gas atmosphere;

a suspension ring with a larger diameter end and a smaller diameter end and attached all along its inner circumference of its smaller diameter end to an outer circumference of the cup, and providing for expansion and contraction during lamp operation; and an outer lamp-front-end ring with a larger diameter end for attachment to a ceramic body of said arc lamp, and a smaller diameter end attached all along its inner circumference to an outer circumference of said larger diameter end of the suspension ring;

wherein said rigid strut system suspends the tungsten cathode electrode in opposition to an anode electrode in a xenon gas atmosphere and maintains a correct arc gap.

6. A method of manufacturing an improved xenon arc lamp, the method comprising the steps of:

forming a cup from a single sheet of Kovar material;

cutting a series of three cutouts in a bottom floor of said cup such that a set of three webs remain that connect an outer ring of said cup to a center hub;

folding a flap in each of said three webs such that a rigid strut system is created;

attaching a tungsten cathode electrode to said center hub; and using a sleeve to bridge a fillet area between said tungsten cathode electrode and each corresponding inside edge of said flaps.

7. The method of claim 6, further comprising the step of:

attaching a sapphire lens all along its circumference inside said cup and providing for a containment seal of said xenon gas atmosphere.

8. The method of claim 7, further comprising the step of:

attaching a suspension ring with a larger diameter end and a smaller diameter end all along its inner circumference of its smaller diameter end to an outer circumference of said cup, and thereby providing for expansion and contraction during lamp operation.

9. The method of claim 8, further comprising the step of:

attaching an outer lamp-front-end ring with a larger diameter end to a ceramic body of said arc lamp, and attaching a smaller diameter end all along its inner circumference to an outer circumference of said larger diameter end of said suspension ring;

wherein, said rigid strut system suspends said tungsten cathode electrode in opposition to an anode electrode in a xenon gas atmosphere and maintains a correct arc gap.

* * * * *